US006652982B2

(12) United States Patent
Spitsberg et al.

(10) Patent No.: US 6,652,982 B2
(45) Date of Patent: Nov. 25, 2003

(54) FABRICATION OF AN ARTICLE HAVING A PROTECTIVE COATING WITH A FLAT PROTECTIVE-COATING SURFACE AND A LOW SULFUR CONTENT

(75) Inventors: Irene Spitsberg, Loveland, OH (US); Ramgopal Darolia, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/944,705

(22) Filed: Aug. 31, 2001

(65) Prior Publication Data

US 2003/0041926 A1 Mar. 6, 2003

(51) Int. Cl.[7] ..... B32B 9/00

(52) U.S. Cl. ..... 428/472.2; 148/276; 148/277; 148/285; 427/248.1; 427/250; 427/255.32; 428/623; 428/469

(58) Field of Search ..... 148/240, 276, 148/277; 427/248.1, 250, 255.32; 428/623, 469, 472.2

(56) References Cited

U.S. PATENT DOCUMENTS 4,414,249 A * 11/1983 Ulion et al. ..... 205/661
5,658,614 A * 8/1997 Basta et al. ..... 427/142

* cited by examiner

*Primary Examiner*—John Sheehan
*Assistant Examiner*—Andrew L. Oltmans
(74) *Attorney, Agent, or Firm*—Gregory Garmong; Carmen Santa Maria; McNees Wallace & Nurick LLC

(57) ABSTRACT

An article having a protective coating is fabricated by providing an article substrate having a substrate surface; and thereafter producing a flattened protective coating on the substrate surface. The step of producing the flattened protective coating includes the steps of depositing a protective coating on the substrate surface, the protective coating having a protective-coating surface, and processing the protective coating to achieve the flattened protective-coating surface. The protective coating is thereafter optionally controllably oxidized. The article substrate and protective coating have an average sulfur content of less than about 10 parts per million by weight at depths measured from the protective-coating surface to a depth of about 50 micrometers below the protective-coating surface.

29 Claims, 3 Drawing Sheets

FABRICATION OF AN ARTICLE HAVING A PROTECTIVE COATING WITH A FLAT PROTECTIVE-COATING SURFACE AND A LOW SULFUR CONTENT

This invention relates to protective systems such as used to protect some components of gas turbine engines and, more particularly, to the protective-coating surface and the protective coating composition.

BACKGROUND OF THE INVENTION

Higher operating temperatures for gas turbine engines are continuously sought in order to increase their efficiency. However, as operating temperatures increase, the high-temperature durability of the components of the engine must correspondingly increase. Significant advances in high-temperature capabilities have been achieved through the formulation of nickel- and cobalt-base superalloys. Nonetheless, when used to form components of the turbine, combustor and augmentor sections of a gas turbine engine, such alloys alone are often susceptible to damage by oxidation and hot corrosion attack and may not retain adequate mechanical properties. For this reason, these components are often protected by an environmental and/or thermal-insulating coating, the latter of which is termed a thermal barrier coating (TBC) system. Ceramic materials and particularly yttria-stabilized zirconia (YSZ) are widely used as a thermal barrier coating (TBC), or topcoat, of TBC systems used on gas turbine engine components. The TBC employed in the highest-temperature regions of gas turbine engines is typically deposited by electron beam physical vapor deposition (EBPVD) techniques that yield a columnar grain structure which is able to expand and contract without causing damaging stresses that lead to spallation.

To be effective, TBC systems must have low thermal conductivity, strongly adhere to the article, and remain adherent throughout many heating and cooling cycles. The latter requirement is particularly demanding due to the different coefficients of thermal expansion between ceramic topcoat materials and the superalloy substrates they protect. To promote adhesion and extend the service life of a TBC system, an oxidation-resistant bond coat is usually employed. Bond coats are typically in the form of overlay coatings such as MCrAlX (where M is iron, cobalt, and/or nickel, and X is yttrium or another rare earth element), or diffusion aluminide coatings. A notable example of a diffusion aluminide bond coat contains platinum aluminide (NiPtAl) intermetallic. When a bond coat is applied, a zone of interdiffusion forms between the substrate and the bond coat. This zone is typically referred to as a diffusion zone.

During the deposition of the ceramic TBC and subsequent exposures to high temperatures, such as during engine service, bond coats of the type described above oxidize to form a tightly adherent alumina (aluminum oxide or $Al_2O_3$) layer or scale that protects the underlying structure from catastrophic oxidation and also adheres the TBC to the bond coat. The service life of a TBC system is typically limited by spallation at or near the interfaces of the alumina scale with the bond coat or with the TBC. The spallation is induced by thermal fatigue as the article substrate and the thermal barrier coating system are repeatedly heated and cooled during engine service.

There is a need for an understanding of the specific mechanisms that lead to the thermal fatigue failure of the protective system, and for structures that extend the life of the coating before the incidence of such failure. The present invention fulfills this need, and further provides related advantages.

BRIEF SUMMARY OF THE INVENTION

The present invention provides an approach for fabricating an article protected by a protective system, and articles protected by the protective system. The life of the protective system is extended under conditions of thermal fatigue by delaying the onset of the alumina scale interface failure mode. The present approach is applicable to environmental-coating protective systems where there is no thermal barrier coating present. However, it realizes its greatest advantages when used in thermal barrier coating systems where the protective coating is a bond coat and a ceramic thermal barrier coating overlies the bond coat.

A method of fabricating an article having a protective coating thereon comprises the steps of providing an article substrate having a substrate surface, thereafter producing a flattened protective coating on the substrate surface by depositing a protective coating on the substrate surface, the protective coating having a protective-coating surface, and processing the protective coating to achieve the flattened protective-coating surface. The protective coating is thereafter optionally exposed to an environment wherein the protective-coating surface is controllably oxidized. The article substrate and protective coating have an average sulfur content of less than about 10 (more preferably less than 5, and most preferably less than 1) parts per million by weight at depths measured from the protective-coating surface to a depth of about 50 micrometers below the protective-coating surface. Optionally but preferably, a ceramic thermal barrier coating is deposited overlying the pre-oxidized protective-coating, so that the protective coating constitutes a bond coat for the thermal barrier coating.

The article substrate preferably is a nickel-base superalloy, and most preferably is a component of a gas turbine engine. The protective coating may be a diffusion aluminide protective coating such as a platinum aluminide protective coating, or it may be an overlay protective coating.

The protective coating may be flattened without removing material from the protective-coating surface, as by peening the protective coating. Alternatively, the protective coating may be flattened by removing material from the protective-coating surface, as by polishing the protective coating. Desirably, the step of processing the protective coating produces a protective-coating surface wherein an average grain boundary displacement height of the protective coating is less than about 3 micrometers, more preferably less than about 1 micrometer, even more preferably less than about 0.5 micrometer, and most preferably substantially zero, over at least about 40 percent of the surface area of the protective coating but more preferably over the entire surface area of the protective coating. Where the processing is accomplished by polishing, the average grain boundary displacement height may be substantially zero in the polished areas, where the polishing is to a mirror finish. In most cases, the step of processing the protective coating is performed after the step of depositing the protective coating is complete. In some cases, however, the steps of depositing the protective coating and processing the protective coating are performed concurrently. Additionally, it is preferred that at least about 40 percent, and more preferably all, of the surface of the protective coating is flattened to have a grain displacement height of less than about 3 micrometers, more preferably less than about 1 micrometer, even more preferably less than about 0.5 micrometer, and most preferably substantially zero.

The optional step of controllable oxidation preferably includes the step of heating the protective coating in an atmosphere having a partial pressure of oxygen of from about $10^{-5}$ mbar to about $10^{3}$ mbar, more preferably from about $10^{-5}$ mbar to about $10^{-2}$ mbar, at an oxidizing temperature of from about 1800° F. to about 2100° F., and for a time of from about ½ hour to about 3 hours. Most preferably, the controllable oxidation is performed by heating the protective coating to a pre-oxidation temperature of from about 2000° F. to about 2100° F. in a heating time of no more than about 45 minutes, preferably from about 1 to about 45 minutes, and more preferably from about 15 to about 35 minutes, and thereafter holding at the pre-oxidation temperature for a time of from about ½ hour to about 3 hours, in an atmosphere having a partial pressure of oxygen of about $10^{-4}$ mbar.

An article having a protective coating thereon comprises an article substrate having a substrate surface, and a protective coating on the substrate surface. The protective coating has a protective-coating surface with an average grain boundary displacement height of less than about 5 micrometers (more preferably 1 micrometer, even more preferably 0.5 micrometer, and most preferably substantially zero) over at least about 40 percent (and preferably 100 percent) of the surface area of the article. The article substrate and the protective coating have an average sulfur content of less than about 10 parts per million by weight at depths measured from the protective-coating surface to a depth of about 50 micrometers below the protective-coating surface. These low sulfur levels may result from the manner in which the protective-coating is deposited. More commonly, however, sulfur is removed from the protective-coating surface by a desulfurization process after the protective coating is deposited. Preferably, a thermal barrier coating is deposited overlying the pre-oxidized protective coating, so that the protective coating constitutes a bond coat for the thermal barrier coating. Features discussed above in relation to the fabrication method may be used in conjunction with the article as well.

It has been known to employ a low-sulfur protective coating or bond coat, where the sulfur content is necessarily less than about 1 part per million by weight. Sulfur preferentially segregates to the interface between the protective coating and the alumina scale, accelerating the spalling of the alumina scale during thermal cycling. The reduction in the sulfur content of the protective coating can delay the onset of such a failure mechanism.

While this low-sulfur approach has proved useful in many instances, in other situations there was little if any improvement resulting from the low sulfur content of the protective coating. This lack of improvement resulted from the intervening failure mechanism of the development of mechanical convolutions in the alumina scale by ratcheting, which in turn resulted from the ridge-like structure of the protective-coating surface that leads to the initiation and propagation of mechanical damage in the ceramic just above the alumina scale and or within the alumina scale itself. In the present approach, the prominence of the ridge-like structure is reduced or eliminated by the flattening procedure. As a result, the onset of failure due to the development of convolutions is delayed, so that failure due to decohesion of the alumina scale from the bond coat becomes the life-limiting factor. Sulfur segregation, which is of great importance in scale adhesion, here plays a greater role in determining the ultimate failure mechanism of the protective structure. As a result, reducing the sulfur content becomes of greater importance, and the present invention provides for such a reduction.

Alternatively stated, failure of the protective coating may result from either of two mechanisms, the development of mechanical convolutions (and associated mechanical damage) or the degradation of the chemical adhesion of the scale to the bond coat, which is directly related to the chemical segregation of sulfur to the surface of the bond coat. The present approach addresses both mechanisms and takes steps to reduce their onset. The result is a longer-lived protective coating or, in the case of the thermal barrier coating system, the bond coat.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
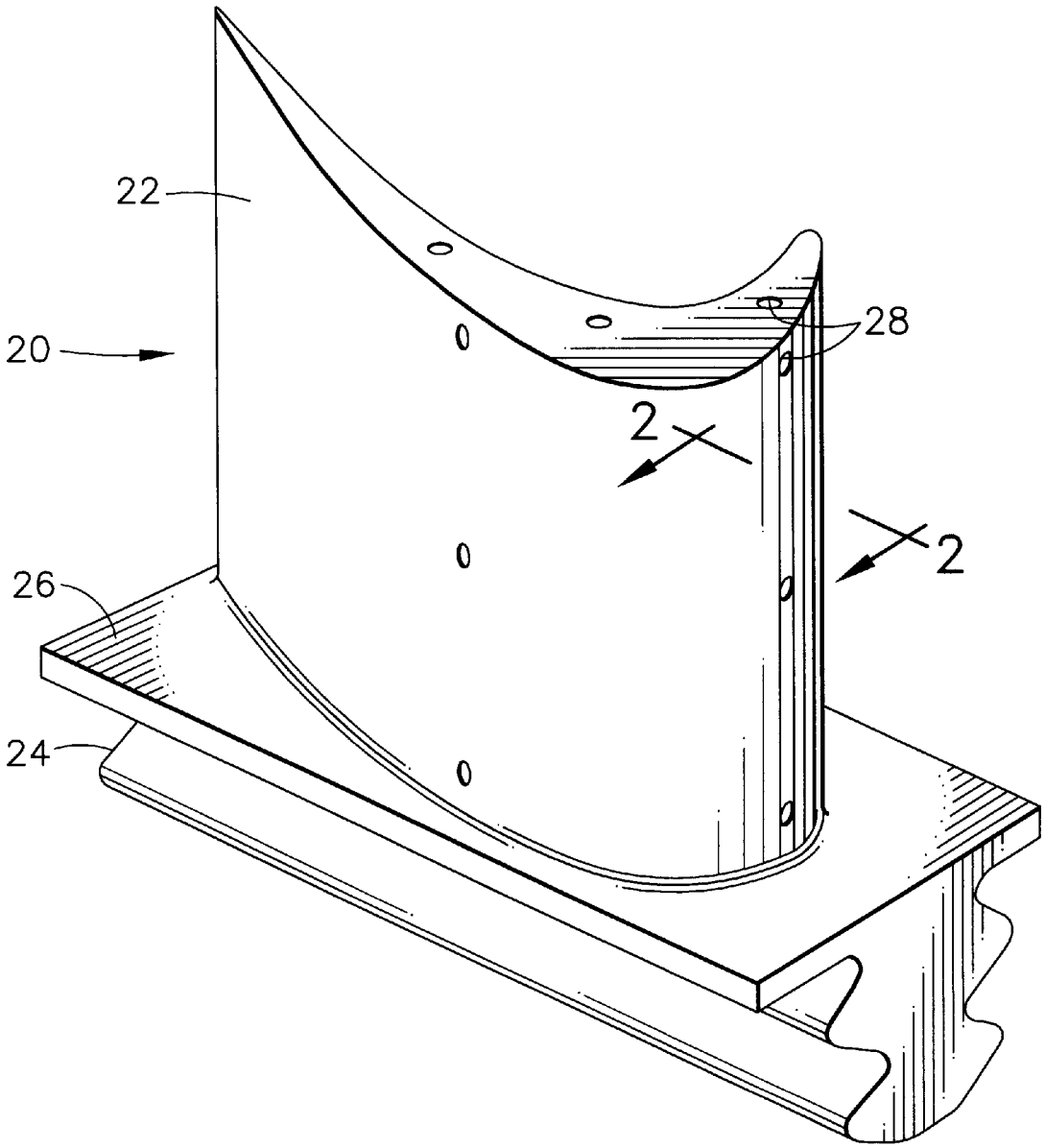
FIG. 1 is a perspective view of a turbine blade.

FIG. 1 depicts a component article of a gas turbine engine such as a turbine blade or turbine vane, and in this illustration a turbine blade 20. The turbine blade 20 is formed of any operable material, but is preferably a nickel-base superalloy. The turbine blade 20 includes an airfoil section 22 against which the flow of hot exhaust gas is directed. (The turbine vane or nozzle has a similar appearance in respect to the pertinent airfoil section, but typically includes other end structure to support the airfoil.) The turbine blade 20 is mounted to a turbine disk (not shown) by a dovetail 24 which extends downwardly from the airfoil 22 and engages a slot on the turbine disk. A platform 26 extends longitudinally outwardly from the area where the airfoil 22 is joined to the dovetail 24. A number of internal passages extend through the interior of the airfoil 22, ending in openings 28 in the surface of the airfoil 22. During service, a flow of cooling air is directed through the internal passages to reduce the temperature of the airfoil 22.

Figure 2:
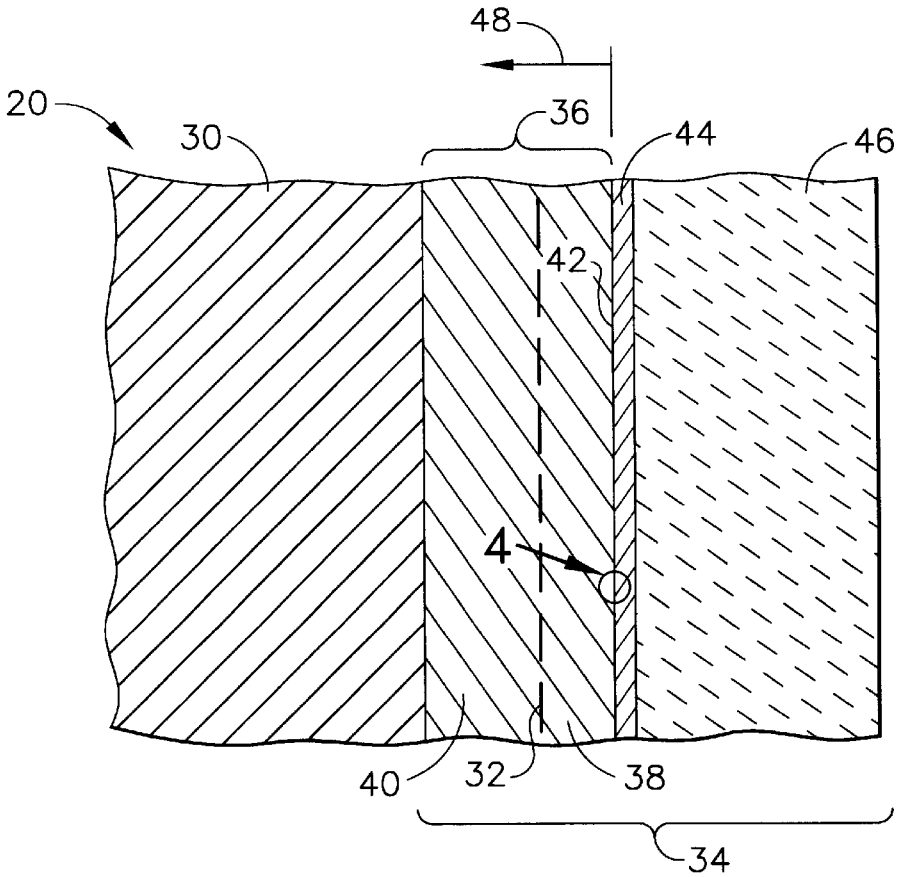
FIG. 2 is an enlarged schematic sectional view through the turbine blade of FIG. 1, taken on lines 2—2.

FIG. 2 is a schematic sectional view, not drawn to scale, through a portion of the turbine blade 20, here the airfoil section 22. The turbine blade 20 has a body that serves as a substrate 30 with a surface 32. Overlying and contacting the surface 32 of the substrate 30, and also extending downwardly into the substrate 30, is a protective coating system 34 including a protective coating 36. In the absence of an overlying ceramic thermal barrier coating, the protective coating 36 is termed an environmental coating. Where there is a thermal barrier coating, the protective coating 36 is termed a bond coat. The protective coating 36 includes a deposited layer 38 and a diffusion zone 40 that is the result of interdiffusion of material from the deposited layer 38 with material from the substrate 30. The process that deposits the deposited layer 38 onto the surface 32 of the substrate 30 is performed at elevated temperature, so that during deposition the material of the deposited layer 38 interdiffuses into and with the material of the substrate 30, forming the diffusion zone 40. The diffusion zone 40, indicated by a dashed line in FIG. 2, is a part of the protective coating 36 but extends downward into the substrate 30.

The protective coating 36 has an outwardly facing protective-coating surface 42 remote from the surface 32 of the substrate 30. An alumina (aluminum oxide, or $Al_2O_3$) scale 44 forms at this protective-coating surface 42 by oxidation of the aluminum in the protective-coating 36 at the protective-coating surface 42. A ceramic thermal barrier coating 46 optionally overlies and contacts the protective-coating surface 42 and the alumina scale 44 thereon.

Figure 3:
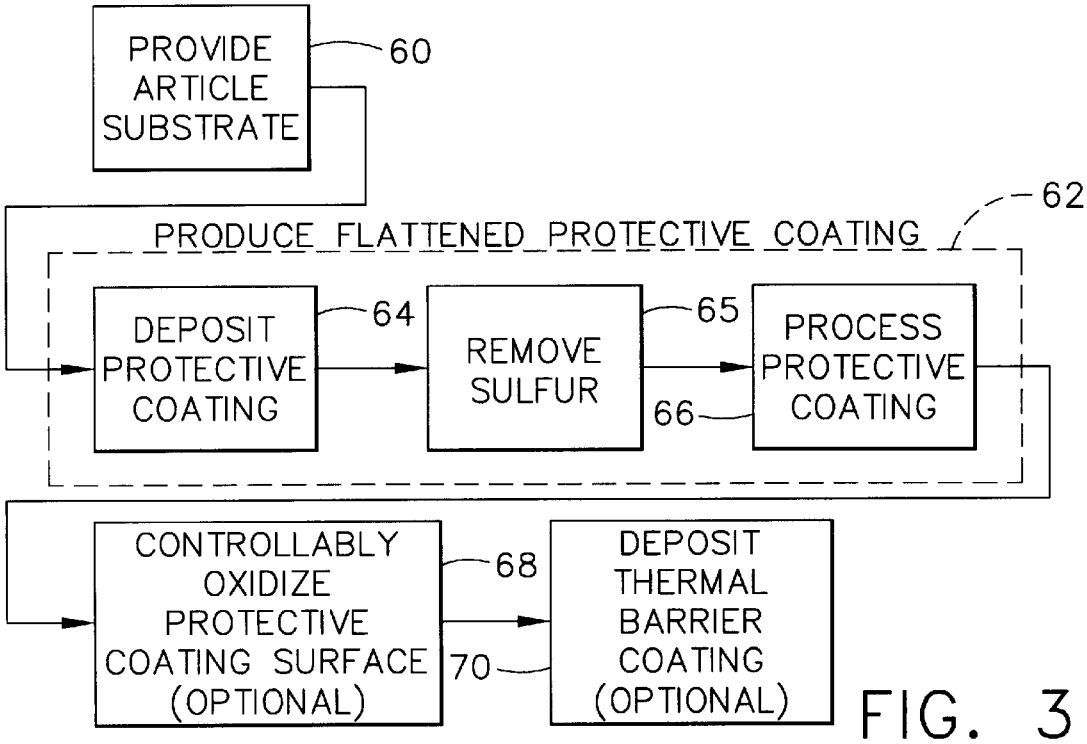
FIG. 3 is a block flow diagram of an approach for preparing a coated gas turbine airfoil.

FIG. 3 is a block flow diagram of a preferred approach for fabricating an article. An article and thence the substrate 30 are provided, numeral 60. The article is preferably a component of a gas turbine engine such as a gas turbine blade 20 or vane (or "nozzle", as the vane is sometimes called), see FIG. 1. The article may be a single crystal article, a preferentially oriented polycrystal, or a randomly oriented polycrystal. The article is most preferably made of a nickel-base superalloy. As used herein, "nickel-base" means that the composition has more nickel present than any other element. The nickel-base superalloys are typically of a composition that is strengthened by the precipitation of gamma-prime phase. The preferred nickel-base alloy has a composition, in weight percent, of from about 4 to about 20 percent cobalt, from about 1 to about 10 percent chromium, from about 5 to about 7 percent aluminum, from 0 to about 2 percent molybdenum, from about 3 to about 8 percent tungsten, from about 4 to about 12 percent tantalum, from 0 to about 2 percent titanium, from 0 to about 8 percent rhenium, from 0 to about 6 percent ruthenium, from 0 to about 1 percent niobium, from 0 to about 0.1 percent carbon, from 0 to about 0.01 percent boron, from 0 to about 0.1 percent yttrium, from 0 to about 1.5 percent hafnium, balance nickel and incidental impurities.

A most preferred alloy composition is René N5, which has a nominal composition in weight percent of about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, about 0.15 percent hafnium, up to about 0.01 percent yttrium, balance nickel and incidental impurities. Other operable superalloys include, for example, René N6, which has a nominal composition in weight percent of about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.15 percent hafnium, about 0.05 percent carbon, about 0.004 percent boron, about 0.01 percent yttrium, balance nickel and incidental impurities; Rene 142, which has a nominal composition, in weight percent, of about 12 percent cobalt, about 6.8 percent chromium, about 1.5 percent molybdenum, about 4.9 percent tungsten, about 6.4 percent tantalum, about 6.2 percent aluminum, about 2.8 percent rhenium, about 1.5 percent hafnium, about 0.1 percent carbon, about 0.015 percent boron, balance nickel and incidental impurities; CMSX-4, which has a nominal composition in weight percent of about 9.60 percent cobalt, about 6.6 percent chromium, about 0.60 percent molybdenum, about 6.4 percent tungsten, about 3.0 percent rhenium, about 6.5 percent tantalum, about 5.6 percent aluminum, about 1.0 percent titanium, about 0.10 percent hafnium, balance nickel and incidental impurities; CMSX-10, which has a nominal composition in weight percent of about 7.00 percent cobalt, about 2.65 percent chromium, about 0.60 percent molybdenum, about 6.40 percent tungsten, about 5.50 percent rhenium, about 7.5 percent tantalum, about 5.80 percent aluminum, about 0.80 percent titanium, about 0.06 percent hafnium, about 0.4 percent niobium, balance nickel and incidental impurities; PWA1480, which has a nominal composition in weight percent of about 5.00 percent cobalt, about 10.0 percent chromium, about 4.00 percent tungsten, about 12.0 percent tantalum, about 5.00 percent aluminum, about 1.5 percent titanium, balance nickel and incidental impurities; PWA1484, which has a nominal composition in weight percent of about 10.00 percent cobalt, about 5.00 percent chromium, about 2.00 percent molybdenum, about 6.00 percent tungsten, about 3.00 percent rhenium, about 8.70 percent tantalum, about 5.60 percent aluminum, about 0.10 percent hafnium, balance nickel and incidental impurities; and MX-4, which has a nominal composition as set forth in U.S. Pat. No. 5,482,789, in weight percent, of from about 0.4 to about 6.5 percent ruthenium, from about 4.5 to about 5.75 percent rhenium, from about 5.8 to about 10.7 percent tantalum, from about 4.25 to about 17.0 percent cobalt, from 0 to about 0.05 percent hafnium, from 0 to about 0.06 percent carbon, from 0 to about 0.01 percent boron, from 0 to about 0.02 percent yttrium, from about 0.9 to about 2.0 percent molybdenum from about 1.25 to about 6.0 percent chromium, from 0 to about 1.0 percent niobium, from about 5.0 to about 6.6 percent aluminum, from 0 to about 1.0 percent titanium, from about 3.0 to about 7.5 percent tungsten, and wherein the sum of molybdenum plus chromium plus niobium is from about 2.15 to about 9.0 percent, and wherein the sum of aluminum plus titanium plus tungsten is from about 8.0 to about 15.1 percent, balance nickel and incidental impurities. The use of the present invention is not limited to these preferred alloys, and has broader applicability.

A flattened protective coating 36 is produced on the surface 32 of the substrate 30, numeral 62. As part of this step 62, the protective coating 36 is deposited, numeral 64. The protective coating 36 is preferably a diffusion aluminide protective coating 36, produced by depositing an aluminum-containing layer onto the substrate 30 and interdiffusing the aluminum-containing layer with the substrate 30 to produce the deposited layer 38 and the diffusion zone 40 shown in FIG. 2. The protective coating 36 may be a simple diffusion aluminide in which only an aluminum-containing layer is deposited onto the surface, or it may be a more-complex diffusion aluminide wherein another layer, preferably platinum, is first deposited upon the surface 32, and the aluminum-containing layer is deposited over the first-deposited layer. In either case, the aluminum-containing layer may be doped with other elements that modify the protective coating 36. The basic application procedures for these various types of protective coatings 36 are known in the art, except for the modifications to the processing and structure discussed herein.

Because the platinum-aluminide diffusion aluminide is preferred, its deposition will be described in more detail. A platinum-containing layer is first deposited onto the surface 32 of the substrate 30. The platinum-containing layer is preferably deposited by electrodeposition. For the preferred platinum deposition, the deposition is accomplished by placing a platinum-containing solution into a deposition tank and depositing platinum from the solution onto the surface 32 of the substrate 30. An operable platinum-containing aqueous solution is $Pt(NH_3)_4HPO_4$ having a concentration of about 4–20 grams per liter of platinum, and the voltage/current source is operated at about ½–10 amperes per square foot of facing article surface. The platinum first coating layer, which is preferably from about 1 to about 6 micrometers thick and most preferably about 5 micrometers thick, is deposited in 1–4 hours at a temperature of 190–200° F.

A layer comprising aluminum and any modifying elements is deposited over the platinum-containing layer by any operable approach, with chemical vapor deposition preferred. In that approach, a hydrogen halide activator gas, such as hydrogen chloride, is contacted with aluminum metal or an aluminum alloy to form the corresponding aluminum halide gas. Halides of any modifying elements are formed by the same technique. The aluminum halide (or mixture of aluminum halide and halide of the modifying element, if any) contacts the platinum-containing layer that overlies the substrate 30, depositing the aluminum thereon. The deposition occurs at elevated temperature such as from about 1825° F. to about 1975° F. so that the deposited aluminum atoms interdiffuse into the substrate 30 during a 4 to 20 hour cycle.

The article substrate 30 and the protective coating 36 have an average sulfur content of less than about 10 (more preferably 5, and most preferably 1) parts per million by weight at depths measured from the protective-coating surface 42 (from the origin and in the direction denoted by an arrow 48 in FIG. 2) to a depth of about 50 micrometers below the protective-coating surface 42. If the average sulfur content exceeds about 10 parts per million by weight, there is a strong tendency for the sulfur to segregate to the region just below the protective-coating surface 42 in an unacceptably high concentration. The high concentration of sulfur contributes to the premature delamination of the alumina scale 44 from the protective coating 36 during thermal fatigue cycling.

The substrate 30 may be furnished with such a low sulfur content, and the process used to deposit the protective coating 36 may deposit the protective coating 36 with the required low sulfur content. More typically, the deposition of the protective coating 36 results in a higher concentration of sulfur near the protective-coating surface 42, and it is necessary to remove the excess sulfur. If so, an optional step of removing sulfur is employed, numeral 65. Any operable desulfurization technique may be used.

In the preferred case, the substrate and overlying layers may be desulfurized after the platinum layer is deposited, after the aluminum-containing layer is deposited, or, preferably, both. The desulfurization after deposition of the platinum layer is accomplished by intermediate heating the platinum layer (and usually the substrate) to an elevated temperature, preferably in an atmosphere of a reducing gas. The reducing gas is preferably hydrogen. The hydrogen reacts with the sulfur reaching an exposed free surface to produce hydrogen sulfide gas, which is removed. The heating is preferably accomplished at a temperature of from about 1925° F. to about 1975° F., for a time of no longer than about 8 hours.

The desulfurization of the aluminum-containing layer is accomplished by heating it, and simultaneously the substrate and platinum layer as well, to an elevated temperature. The heating is preferably accomplished in a reducing atmosphere such as hydrogen under the same conditions discussed above and incorporated here. The heating is preferably accomplished at a temperature of from about 1800° F. to about 1975° F., for a time of from about 1 to about 4 hours. If lower temperatures and/or shorter times are used, the final desulfurization may be incomplete.

In both desulfurizing procedures, if higher temperatures and/or longer times are used, no further substantial gain is achieved, and there is a concern with undesirable microstructural alterations to the underlying substrate and a reduction in the aluminum content of the coating if the desulfurization treatment is performed after the coating deposition. There is some further interdiffusion of the platinum and aluminum-containing layers during this treatment, subsequent treatments at elevated temperature, and service at elevated temperature.

During the desulfurization heat treatments, some elements such as yttrium from the substrate and calcium from the coating segregate to the exposed free surface, resulting in reduced chemical activity of the sulfur at the surface. Each of these effects inhibits the combining of sulfur with hydrogen at the exposed free surface. Therefore, as part of either or both of the desulfurization heat treatments, material having a higher concentration of sulfur is optionally removed from the free surface by any operable technique after heating. Grit blasting with a grit such as number 80 grit at 60 pounds per square inch or vapor honing is preferred to remove material from the free surface. Preferably, a thickness of material of from about 0.5 micrometers to about 2 micrometers is removed.

The protective coating 36 is next processed to achieve a flattened protective-coating surface 42, numeral 66. The flattening may be achieved either with an approach that does not remove a substantial amount of metal from the surface 42 of the protective coating 36, or with an approach that intentionally removes metal from the surface 42 of the protective coating 36. Both have been demonstrated as operable.

Figure 4:
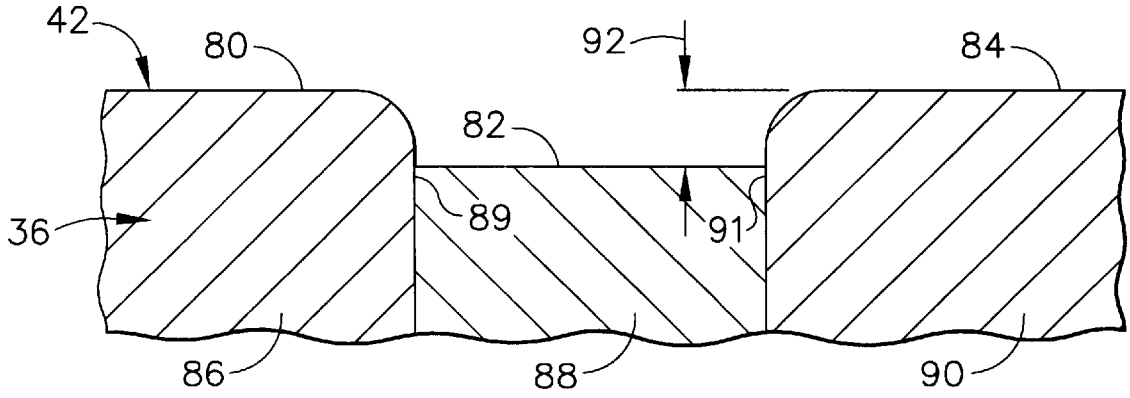
FIG. 4 is a schematic detail of the surface of the bond coat, taken in region 4 of FIG. 2 but without the alumina scale present, prior to flattening of the surface.
Figure 5:
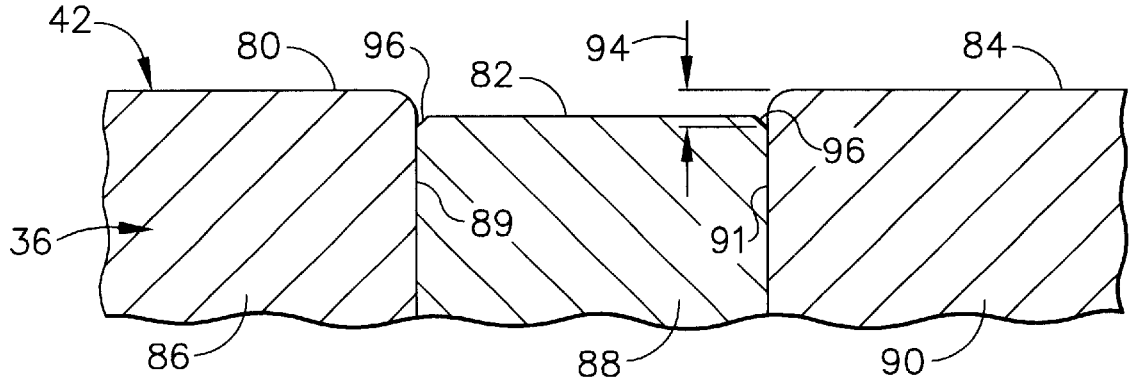
FIG. 5 is a schematic detail of the surface of the bond coat similar to that of FIG. 4, but after flattening of the surface.

FIGS. 4–5 illustrate the meaning of "flattening" and "polishing" as used herein. The surface 42 of the protective coating 36 is not perfectly flat when viewed at high magnification in a sectioning plane perpendicular to the surface 42. Instead, as seen in FIG. 4, there is a local maximum vertical displacement (i.e., perpendicular to the surface 42) between the points on the surfaces of adjacent pairs of grains at the grain boundaries. For example, in FIG. 4 there is a vertical displacement between respective surfaces 80 and 82 of neighboring grains 86 and 88 at a grain boundary 89, and another vertical displacement between respective surfaces 82 and 84 of neighboring grains 88 and 90 at a grain boundary 91. This vertical displacement is an initial grain boundary displacement height 92. The initial average magnitude of the grain boundary displacement height 92 for a diffusion aluminide protective coating is typically on the order of about 5 micrometers. This magnitude of the grain boundary displacement height leads to a failure mechanism of the alumina scale 44 during subsequent service termed ratcheting that produces convolutions in the alumina scale 44 in the neighborhood of the grain boundaries 89 and 91.

According to the present approach, the magnitude of the initial grain boundary displacement height 92 is reduced to a maximum final grain boundary displacement height 94 as illustrated in FIG. 5 by the processing 66. There may be slight grooves 96 at the intersections of the grain boundaries 89 and 91 with the surface 42. The final grain boundary displacement height 94 is measured to the bottoms of the grooves 96, where present, or to the grain surface 82 where no grooves 96 are present. Where the surfaces 82 and 84 are at the same height and there is a groove 96 present, the grain boundary displacement height 94 is measured from the bottom of the groove 96 to either the surface 82 or the surface 84. Where the surfaces 82 and 84 are at the same height and there are no grooves 96 present, the grain boundary displacement height 94 is zero. The average final grain boundary displacement height 94 is less than about 3 micrometers, more preferably less than about 1 micrometer, more preferably less than about 0.5 micrometer, and most preferably substantially zero, to suppress the incidence of the convolution/ratcheting failure mechanism. Achieving these grain boundary displacement heights 94 over 40 percent or more of the grain boundaries results in improvement in the service life of the protective coating, although it is preferred that the indicated grain boundary displacement heights 94 are achieved over all of the grain boundaries. It is further preferred that at least about 40 percent, and more preferably all, of the surface of the protective coating has a grain displacement height of less than about 3 micrometers, more preferably less than about 1 micrometer, more preferably less than about 0.5 micrometer to suppress failure initiating at locations away from the grain boundaries.

The grain boundary displacement height is determined in an enlarged sectional view like that of FIG. 5, taken in a plane perpendicular to the protective-coating surface 42 and measured across the locations where grain boundaries in the protective coating 36 intersect the protective-coating surface 42. This reduction in the average grain boundary displacement height reduces the severity of, and extends the time of the onset of, the thermal cycling deformation convolution mechanism that leads to failure of the alumina scale 44.

The processing 66 (i.e., flattening) without removal of metal may be accomplished by peening (sometimes termed "shot peening"). In this technique, the surface 42 of the protective coating 36 is impacted with a flow of a shot made of a material that is hard relative to the protective coating 36, so that the protective coating 36 is deformed. The peening has the effect of mechanically smashing down the high points of the surface 42 of the protective coating 36, so that the surface is flattened. The preferred peening approach is to peen the surface 42 with zirconia or stainless steel shot with an intensity of from about 6A to about 12A for a typical aluminum coating, but depending upon the hardness of the protective coating 36. If the peening intensity is lower than this range, there is insufficient plastic deformation to achieve the flattening. If the peening intensity is higher than this range, there may be cracking or other damage to the protective coating 36 or to the underlying substrate 30. Optionally, the peened article may be heat treated after peening, to either stress relieve or recrystallize the protective coating 36. A stress-relief heat treatment may be achieved at 1925° F. in two hours. A recrystallize heat treatment may be achieved at 2050° F. in two hours.

The processing 66 with removal of metal may be accomplished by polishing. In this technique, the surface is polished so that a small amount of metal, such as about 2 micrometers thickness or more, is removed from the surface 42 of the protective coating 36. The metal is not removed uniformly, but instead is preferentially removed from the grain boundary ridge and other defect regions that extend higher than their neighboring grains. The result is that the average magnitude of the final grain boundary displacement height 94 is reduced. Polishing may be accomplished by any operable technique wherein the difference between the high points and the low points is reduced. The preferred approach is mechanical polishing, but other types of polishing such as electrochemical polishing may be used where operable. To demonstrate the operability of the process, specimens of nickel-base superalloy substrates with platinum aluminide protective coatings 36 were vibratory polished using a Syntron machine with a 400 gram load and a 1 rpm rotation speed. The result is a highly polished surface that may be mirror-like depending upon the extent of the polishing. In commercial practice with irregularly shaped articles, polishing may be accomplished, for example, by tumbling, vibrolapping, or electropolishing.

After the processing 66, the protective-coating surface 42 is optionally exposed to an environment wherein the protective-coating surface is controllably oxidized to form the alumina scale 44, numeral 68. The parameters of the oxidation treatment are controlled to produce the desired thin, pure alumina scale 44. The controlled parameters include the partial pressure of oxygen, the temperature range of the pre-oxidation treatment 68, the heating rate to the pre-oxidation temperature, and the time of the pre-oxidation treatment.

To form the desired alumina scale 44, the partial pressure of oxygen is preferably between about $10^{-5}$ mbar (millibar) to about $10^{-5}$ mbar, more preferably between about $10^{-5}$ mbar and about $10^{-2}$ mbar. Most preferably, the partial pressure of about $10^{-4}$ mbar, which produces the best thermal fatigue life in furnace cycle testing. The pre-oxidation step 68 is performed without combustion gas or other sources of corrodants present, which otherwise interfere with the formation of the desired high-purity alumina scale 44. The pre-oxidation temperature is preferably from about 1800° F. to about 2100° F., most preferably from about 2000° F. to about 2100° F. The higher pre-oxidation temperatures are preferred to favor the formation of alpha alumina, but the indicated maximum temperature may not be exceeded due to the potential for damage of the superalloy substrate. The article to be pre-oxidized is desirably heated from room temperature to the pre-oxidation temperature in about 45 minutes or less, more preferably from about 15 to about 35 minutes. If the heating is too slow, there is an opportunity for the formation of detrimental, less adherent, oxide phases within the alumina scale 44. The adherence of the alumina scale 44 to the protective coating is therefore reduced. The time at the pre-oxidizing temperature is preferably from about ½ hour to about 3 hours, to achieve a pure alumina scale 44 having a thickness of from about 0.1 micrometer to about 1 micrometer.

If the pre-oxidation parameters lie outside these ranges, an alumina scale will be produced, but it will be less desirable than the alumina scale 44 produced by pre-oxidation within these ranges. Comparative microanalysis (scanning electron microscope and XPS) of alumina scale produced using the indicated pre-oxidation parameters and alumina scale produced outside the indicated pre-oxidation parameters disclosed variations in the nature of the alumina scale. Non-uniform microstructures and finer alumina grain sizes resulted when the pre-oxidation pressure was greater than about $10^{-4}$ mbar. The non-uniformity increased when other elements than aluminum and oxygen were present in the alumina scale. Oxygen pressures within the range of from about $10^{-5}$ mbar to about $10^{3}$ mbar yielded desirable "ridge" type microstructures characteristic of alpha alumina when no elements other than aluminum and oxygen were present in the oxide. Low partial pressures of oxygen, below about $10^{-5}$ mbar, result in internal oxidation along with an outward diffusion of aluminum. Such a structure has reduced adhesion to the protective coating 36.

Optionally but preferably, the thermal barrier coating 46 is deposited overlying the flattened and oxidized protective-coating surface 42 and the alumina scale 44 that has formed thereon, numeral 70. The optional ceramic thermal barrier coating 46, where present, is preferably from about 0.003 to about 0.010 inch thick, most preferably about 0.005 inch thick. The ceramic thermal barrier coating 46 is preferably yttria-stabilized zirconia, which is zirconium oxide containing from about 2 to about 12 weight percent, preferably from about 4 to about 8 weight percent, of yttrium oxide. Other operable ceramic materials may be used as well. The ceramic thermal barrier coating 46 may be deposited by any operable technique, such as electron beam physical vapor deposition or plasma spray.

The low sulfur content and flattening of the protective coating to produce the alumina scale 44 must be employed together in the present invention. The flattening of the protective-coating surface 42 (step 66) reduces the tendency of the protective coating 36 to form the convolutions by a ratcheting mechanism that lead to spalling of the alumina that forms on the protective-coating surface 42. A high sulfur content contributes to early failure of the protective coating system 34 by segregating to the interface between the protective coating 36 and the alumina scale 44, and causing delamination of the alumina scale 44 from the protective coating 36. The use of the low sulfur content suppresses the delamination of the alumina scale 44 from the protective coating 36 by a spallation process. Both of these mechanisms of failure are addressed and their tendency to cause early failure is suppressed. Suppressing only one of the failure mechanisms may have some beneficial effect, but not as much beneficial effect as when both failure mechanisms are treated together as here.

The optional controlled oxidation of the protective-coating surface improves the bond strength between the protective coating and the alumina scale, and also slows the growth of the alumina scale. By forming the alumina scale by a controlled oxidation, the slow-growing alumina scale 44 is formed, which reduces stresses posed at the alumina scale 44/protective coating 36 interface. This, in turn, delays the start of the delamination failures.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of fabricating an article having a protective coating thereon, comprising the steps of providing an article substrate having a substrate surface; and thereafter producing a flattened protective coating of a diffusion aluminide on the substrate surface, the step of producing the flattened protective coating including the steps of depositing a diffusion aluminide protective coating on the substrate surface, the diffusion aluminide protective coating having a protective-coating surface of the diffusion aluminide, and processing the diffusion aluminide protective coating to achieve the flattened protective-coating surface of the diffusion aluminide, wherein the article substrate and the diffusion aluminide protective coating have an average sulfur content of less than about 10 parts per million by weight at depths measured from the protective-coating surface to a depth of about 50 micrometers below the protective-coating surface of the diffusion aluminide.

2. The method of claim 1, wherein the step of providing the article substrate includes the step of providing the article substrate comprising a nickel-base superalloy.

3. The method of claim 1, wherein the step of providing the article substrate includes the step of providing the article substrate comprising a component of a gas turbine engine.

4. The method of claim 1, wherein the step of depositing the protective coating includes the step of depositing a platinum aluminide protective coating.

5. The method of claim 1, wherein the step of processing the protective coating includes the step of flattening the protective-coating surface without removing material from the protective-coating surface.

6. The method of claim 1, wherein the step of processing the protective coating includes the step of peening the protective coating.

7. The method of claim 1, wherein the step of processing the bond coat includes the step of peening the bond coat with a peening intensity of from about 6A to about 12A.

8. The method of claim 1, wherein the step of processing the protective coating includes the step of flattening the protective-coating surface by removing material from the protective-coating surface.

9. The method of claim 1, wherein the step of processing the protective coating includes the step of polishing the protective coating.

10. The method of claim 1, wherein the step of processing the protective coating includes the step of polishing the protective coating by a technique selected from the group consisting of tumbling, vibrolapping, and electropolishing.

11. The method of claim 1, wherein the step of processing the protective coating includes the step of processing the protective coating to achieve a flattened protective-coating surface over at least about 40 percent of grain boundaries of the protective coating.

12. The method of claim 1, wherein the steps of depositing the protective coating and processing the protective coating are performed concurrently.

13. The method of claim 1, wherein the step of processing the protective coating is performed after the step of depositing the protective coating.

14. A method of fabricating an article having a protective coating thereon, comprising the steps of providing an article substrate having a substrate surface; and thereafter producing a flattened protective coating on the substrate surface, the step of producing the flattened protective coating including the steps of depositing the protective coating on the substrate surface, the protective coating having a protective-coating surface, and processing the protective coating to achieve the flattened protective-coating surface, wherein the article substrate and protective coating have an average sulfur content of less than about 10 parts per million by weight at depths measured from the protective-coating surface to a depth of about 50 micrometers below the protective-coating surface; and thereafter heating the protective coating in an atmosphere having a partial pressure of oxygen of from about $10^{-5}$ mbar to about $10^{3}$ mbar.

15. The method of claim 14, wherein the step of heating the protective coating includes the step of heating the protective coating in an atmosphere having a partial pressure of oxygen of from about $10^{-5}$ mbar to about $10^{-2}$ mbar.

16. The method of claim 14, wherein the step of heating the protective coating includes the step of heating the protective coating in an atmosphere having a partial pressure of oxygen of about $10^{-4}$ mbar.

17. The method of claim 1, including an additional step, after the step of producing the flattened protective coating, of heating the protective coating to an oxidizing temperature of from about 1800° F. to about 2100° F.

18. The method of claim 1, including an additional step, after the step of producing the flattened protective coating, of heating the protective coating to an oxidizing temperature in a time of from about 1 to about 45 minutes.

19. The method of claim 1, including an additional step, after the step of producing the flattened protective coating, of heating the protective coating to a temperature of from about 2000° F. to about 2100° F., for a time of from about ½ hour to about 3 hours, and in an atmosphere having a partial pressure of oxygen of about $10^{-4}$ mbar.

20. The method of claim 1, wherein the step of processing the protective coating includes the step of producing the protective-coating surface having an average grain boundary displacement height is less than about 3 micrometers.

21. A method of fabricating an article having a protective coating thereon, comprising the steps of providing an article substrate having a substrate surface; thereafter producing a flattened protective coating on the substrate surface, the step of producing the flattened protective coating including the steps of depositing the protective coating on the substrate surface, the protective coating having a protective-coating surface, and processing the protective coating to achieve the flattened protective-coating surface, wherein the article substrate and protective coating have an average sulfur content of less than about 10 parts per million by weight at depths measured from the protective-coating surface to a depth of about 50 micrometers below the protective-coating surface; and thereafter removing sulfur from the protective-coating surface.

22. The method of claim 1, wherein the article substrate and protective coating have an average sulfur content of less than about 5 parts per million by weight at depths measured from the protective-coating surface to the depth of about 50 micrometers below the protective-coating surface.

23. A method of fabricating an article having a protective coating thereon, comprising the steps of providing an article substrate having a substrate surface; and thereafter producing a flattened protective coating on the substrate surface, the step of producing the flattened protective coating including the steps of depositing the protective coating on the substrate surface, the protective coating having a protective-coating surface, and processing the protective coating to achieve the flattened protective-coating surface, wherein the article substrate and protective coating have an average sulfur content of less than about 10 parts per million by weight at depths measured from the protective-coating surface to a depth of about 50 micrometers below the protective-coating surface, and wherein the article substrate and protective coating have an average sulfur content of less than about 1 part per million by weight at depths measured from the protective-coating surface to the depth of about 50 micrometers below the protective-coating surface.

24. The method of claim 1, further including an additional step, after the step of producing a flattened protective coating, of controllably oxidizing the protective-coating surface.

25. An article having a protective coating thereon, comprising a nickel-based superalloy article substrate having a substrate surface; and a protective diffusion aluminide coating on the substrate surface, the protective coating having an average grain boundary displacement height of less than about 3 micrometers, wherein the article substrate and the protective coating have an average sulfur content of less than about 10 parts per million by weight at depths measured from the protective-coating surface to a depth of about 50 micrometers below the protective-coating surface.

26. The article of claim 25, wherein the article further includes a thermal barrier coating overlying the protective coating.

27. The article of claim 25, wherein the average grain boundary displacement height is less than about 0.5 micrometer.

28. The method of claim 1, including an additional step, after the step of producing the flattened protective coating, of heating the protective coating in an atmosphere having a partial pressure of oxygen of from about $10^{-5}$ mbar to about $10^{-2}$ mbar.

29. The method of claim 1, further including an additional step, after the step of producing, of depositing a thermal barrier coating overlying the protective-coating surface.

* * * * *

UNITED STATES PATENT AND TRADEMARK OFFICE

CERTIFICATE OF CORRECTION

PATENT NO. : 6,652,982 B2
DATED : November 25, 2003
INVENTOR(S) : Irene Spitsberg and Ramgopal Darolia It is certified that error appears in the above-identified patent and that said Letters Patent is hereby corrected as shown below:

Column 6,
Line 25, "molybdenum" should be -- molybdenum, --.

Column 10,
Line 17, "to about $10^{-5}$ mbar" should be -- to about $10^{3}$ mbar --.

Signed and Sealed this

Thirtieth Day of March, 2004

JON W. DUDAS
*Acting Director of the United States Patent and Trademark Office*